US005895037A

United States Patent [19]

Baureis et al.

[11] Patent Number: 5,895,037

[45] Date of Patent: Apr. 20, 1999

[54] DRIVE TRANSMISSION FOR A PULL SUCKER OR FORWARDING SUCKER, IN PARTICULAR, FOR A DEVICE FOR CORRECTING MISALIGNED SHEETS

[75] Inventors: Martin Baureis, Wiesloch; Andreas Fricke, Eberbach; Jürgen Zeltner, Hirschberg, all of Germany

[73] Assignee: Heidelberger Druckmaschinen AG, Heidelberg, Germany

[21] Appl. No.: 08/784,479

[22] Filed: Jan. 17, 1997

[30] Foreign Application Priority Data

Jan. 17, 1996 [DE] Germany ..... 196 01 470

[51] Int. Cl.[6] ..... B65H 3/42

[52] U.S. Cl. ..... 271/92; 271/95

[58] Field of Search ..... 271/90, 92, 93, 271/95, 103, 105, 107, 108

[56] References Cited

U.S. PATENT DOCUMENTS

| | | | |
|---|---|---|---|
| 2,222,459 | 11/1940 | Backhouse | 271/92 |
| 2,225,006 | 12/1940 | Gudger et al. | 271/93 |
| 2,233,935 | 3/1941 | Backhouse | 271/93 |
| 2,247,473 | 7/1941 | Binder | 271/103 |
| 3,071,371 | 1/1963 | Wickland | 271/92 |
| 3,695,606 | 10/1972 | Wirz . | |
| 3,809,389 | 5/1974 | Wirz | 271/93 |
| 3,937,457 | 2/1976 | Schwebel | 271/92 |
| 5,052,672 | 10/1991 | Horii . | |

FOREIGN PATENT DOCUMENTS

| | | |
|---|---|---|
| 0 417 898 A1 | 3/1991 | European Pat. Off. . |
| 1 177 652 | 9/1964 | Germany . |
| 1 929 714 | 10/1970 | Germany . |
| 1 786 029 | 4/1971 | Germany . |
| 720 3336 | 1/1972 | Germany . |
| 2 132 438 | 1/1973 | Germany . |
| 2 163 083 | 6/1973 | Germany . |
| 2 225 001 | 11/1973 | Germany . |
| 1 038 399 | 10/1964 | United Kingdom . |
| 2 066 780 | 7/1981 | United Kingdom . |

*Primary Examiner*—H. Grant Skaggs
*Assistant Examiner*—Patrick Mackey
*Attorney, Agent, or Firm*—Herbert L. Lerner; Laurence A. Greenberg

[57] ABSTRACT

A drive transmission for a pull or forwarding sucker located in a suction head of a sheet feeder for translatorily driving a sucker-carrying support movable in a guide provided on a suction-head housing, the sucker-carrying support being connected articulatingly to at least one coupler swivelable about an axis extending transversely to the translatory motion of the sucker-carrying support, includes a first drive cam for moving the coupler and for effecting a forwarding motion, and a second drive cam for a roller lever mounted in the suction-head housing and being swivelably connected to the coupler, the second drive cam having a profile for leveling the translatory motion of the sucker-carrying support.

5 Claims, 4 Drawing Sheets

DRIVE TRANSMISSION FOR A PULL SUCKER OR FORWARDING SUCKER, IN PARTICULAR, FOR A DEVICE FOR CORRECTING MISALIGNED SHEETS

BACKGROUND OF THE INVENTION

1. Field of the Invention

The invention relates to a drive transmission for a pull or forwarding sucker, in particular, for a device for correcting misaligned sheets, the pull sucker drive transmission being located in a suction head of a sheet feeder for translatorily driving a sucker-carrying support movable in a guide provided on a suction-head housing, the sucker-carrying support being connected articulatingly to at least one couple element or coupler swivelable about an axis extending transversely to the translatory motion of the sucker-carrying support, the couple element being movable by a drive cam. The drive transmission for the pull or forwarding sucker is particularly suited for providing the misalignment-correction device in the suction head of the sheet feeder of a sheet-fed printing press.

A drive transmission for a pull or forwarding sucker having the foregoing general features has become known heretofore from the German Patent 11 77 652 wherein two spaced-apart pull or forwarding suckers are provided at pipe branches on a sucker-carrying support formed of a pipe disposed transversely to a translatory sucker movement. The sucker-carrying support is connected, by substantially vertically extending tubular connecting members, to a shaft fixedly mounted on the press. The drive is effected by a drive cam which acts against a roller lever on the shaft, a lever attached to the sucker-carrying support engaging in a stationary coulisse or connecting-link guide in order to produce a forwarding or conveying stroke of the respective suckers. For a misalignment correction, such as a correction of a skewed sheet, one of the two suckers may be slightly rotated about the transverse axis thereof. For this purpose, the respective sucker is connected to a pull rod by a lever, an articulated connection between the pull rod and the sucker-carrying support being displaceable by adjusting elements. The adjusting elements can be actuated only when the printing press is at a standstill. When more than two pull or forwarding suckers are used, a sheet misalignment correction inevitably causes a distortion of the paper sheet.

German Patent 21 32 438 discloses a linear guide for forwarding or pull suckers. In order to absorb torques occurring in the guides, additional rollers are provided and v-shaped guide rails are used, respectively. Assembling or mounting the rollers and v-shaped guide rails requires a considerable outlay of technical effort, if a play-free setting is to be achieved. This conventional linear guide uses needle bearings and, at high operating speeds, the needles do not reliably roll off in the guides due to high resulting accelerations.

This leads to increased wear and tear. According to the German Published and Prosecuted Patent Application (DE-AS) 22 25 001, the misaligned-sheet correction device constructed on this conventional linear guide has a swivel or hinge joint in order to be able to rotate the sucker-carrying support, the axis of the swivel being perpendicular to the sheet surface. A relatively complex mounting support is required to avoid tilting effects at the sucker-carrying support. This is in conjunction with an increase in the translatorily moved masses, due to which especially the joints are greatly stressed.

A misaligned-sheet correction device also suitable for translatorily moved sucker-carrying supports has become known heretofore from the German Utility Model or Petty Patent (DE-GM) 72 03 336, the relatively complex construction of the misaligned-sheet correction device having dynamically similar undesirable properties.

In a device according to the aforementioned German Patent 11 77 652, suckers are located on a coupler or connecting rod which is guided by swinging or rocking levers and a cam segment. Thus, suckers provided at arbitrary locations may not execute a purely translatory transport or conveying movement. The misaligned-sheet correction may be performed only by using two suckers, because it is effected by pivoting a sucker about a horizontal axis extending transversely to the paper travel direction.

A basically comparable arrangement for three suckers is disclosed in the German Patent 21 63 083. The three suckers are arranged symmetrically to the center of the sheet in order to ensure that the sheet is only slightly distorted.

The German Patent 17 86 029 describes a drive transmission for a forwarding or pull sucker provided in a suction head of a sheet feeder wherein a sucker-carrying support carrying an arbitrary number of suckers is articulatedly connected to a swinging half-axle and, by a control cam, aligns the sheet with the leading edge thereof during the feed or stroke, and indeed so that the pipe carrying the suckers is mounted so as to be swivelable in the middle thereof about the vertical axis thereof and is connected to a lever having a free end which slides in a guide angularly adjustable with respect to the sheet-transport or travel direction.

SUMMARY OF THE INVENTION

It is accordingly an object of the invention to provide a drive transmission for a forwarding or pull sucker having the foregoing features for transporting a sheet as horizontally as possible and for providing the possibility of performing a sheet-misalignment correction without distorting the sheet, with an adjustment actuatable while the printing press is running.

With the foregoing and other objects in view, there is provided, in accordance with the invention, a drive transmission for a pull or forwarding sucker located in a suction head of a sheet feeder for translatorily driving a sucker-carrying support movable in a guide provided on a suction-head housing, the sucker-carrying support being connected articulatingly to at least one coupler swivelable about an axis extending transversely to the translatory motion of the sucker-carrying support, comprising a first drive cam for moving the coupler and for effecting a forwarding motion, and a second drive cam for a roller lever mounted in the suction-head housing and being swivelably connected to the coupler, the second drive cam having a profile for leveling the translatory motion of the sucker-carrying support.

In accordance with another feature of the invention, the sucker-carrying support is movably guided at least at one end thereof in a guide provided on the suction-head housing, and is articulatedly connected to a frame forming the coupler and is swivelable about the axis transverse to the translatory motion of the sucker-carrying support, the first drive cam for effecting the forwarding motion being above the transverse axis at a spaced distance therefrom, the first drive cam being effective against a cam follower mounted on the frame forming the coupler.

In accordance with a further feature of the invention, the frame forming the coupler is swivelable about an axis extending parallel to the axis transverse to the translatory motion of the sucker-carrying support and is connected to one end of a roller lever mounted so as to be swivelable about a shaft provided in the suction-head housing, the other end of the roller lever carrying a cam follower by which the roller lever engages with the first drive cam.

In accordance with an added feature of the invention, the frame and the sucker-carrying support have two connecting joints with a common axis.

In accordance with an additional feature of the invention, one of the connecting joints is disposed on a bell-crank lever mounted on the frame so as to be swivelable about an axis extending parallel to the common axis of the two connecting joints.

In accordance with yet another feature of the invention, the drive transmission includes a vertical frame element swivelably connected to the bell-crank lever, and a roller mounted on a free arm of the bell-crank lever engages in an adjustable guide, the two connecting joints being movable in a cardanic manner between the frame and the sucker-carrying support, one of the connecting joints connecting the other arm of the bell-crank lever to the sucker-carrying support.

In accordance with yet a further feature of the invention, the guide for the roller mounted on the bell-crank lever is adjustably disposed on the suction-head housing.

In accordance with a concomitant feature of the invention, the guide is mounted on the suction-head housing so as to be swivelable about a swivel axis and is connected to an adjusting device which is actuatable while the printing press is running.

With the foregoing structural features of the invention, a drive transmission for a pull or forwarding sucker predominantly suitable for large sheet sizes is provided which, when operating even at high press speeds, causes only little noise and produces little wear and tear, and ensures a largely straightforward trouble-free sheet transport. In a sheet format, the number and arrangement of forwarding suckers may be chosen arbitrarily. The sucker-carrying support may be guided on one side or on both sides thereof, and may be connected articulatedly to a frame forming the connecting member or coupler so as to be swivelable about a transverse axis, and with the first drive cam causing the forwarding motion and, above the transverse axis at a spaced distance therefrom, being effective against or in engagement with a cam follower mounted in the frame. Preferably, the frame is connected to one end of a roller lever mounted so as to be swivelable about an axis extending parallel to the transverse axis, the roller lever being mounted so as to be swivelable about a shaft provided in a suction-head housing, the other end of the roller lever carrying a cam follower abutting against the second drive cam so that the second drive cam with a suitably synchronized profile achieves a leveling or straightening of the translatory, substantially horizontal pulling or forwarding motion produced by the first drive cam.

A forwarding or pulling sucker drive having the aforementioned features is especially suitable for a construction having a device for correcting misaligned sheets during sheet transport through the suction head of a sheet feeder of a sheet-fed printing press.

According to another inventive concept, the misalignment correction is effected by providing that a vertical frame element and the sucker-carrying support be swivelably connected to one another by a bell-crank lever, and that a roller mounted on the free arm of the bell-crank lever engages in an adjustable guide, the two connecting joints between the frame and the sucker-carrying support being cardanic joints. Detailed features of the embodiment are explained hereinbelow with reference to a particular embodiment. Such an embodiment has the advantage that the adjustment of the device for effecting the misalignment correction may be performed while the printing press is running, which represents a major advantage with respect to heretofore known misalignment-correction arrangements. A particular advantage is that the misalignment correction is performed without distorting the sheet, because the relative position of the suckers to one another remains unchanged during transport, and the misalignment correction is effected simultaneously. The roller mounted on the bell-crank lever runs in a preferably swivelably mounted guide provided on the suction-head housing, the guide being mounted on the suction-head housing so as to be swivelable about a transverse axis and being adjustable by a spindle which may be rotated manually and penetrates a spindle nut provided at the guide. This adjustment may be performed while the machine is running.

Other features which are considered as characteristic for the invention are set forth in the appended claims.

Although the invention is illustrated and described herein as embodied in a drive transmission for a forwarding or pull sucker, in particular, for a device for correcting misaligned sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
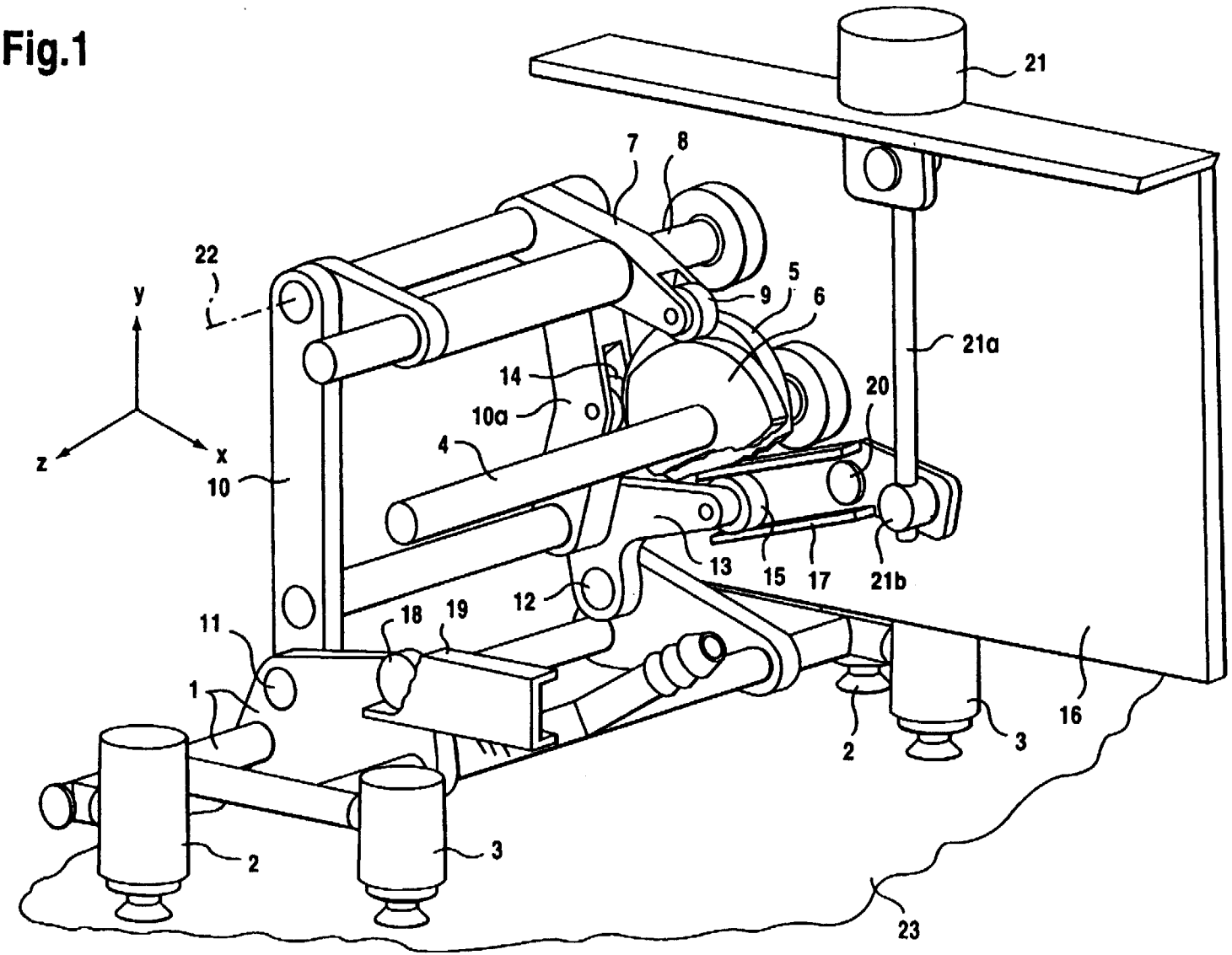
FIG. 1 is a front, right-hand side and top perspective view of an embodiment of a drive transmission for a pull or forwarding sucker having features in accordance with the invention.
Figure 2:
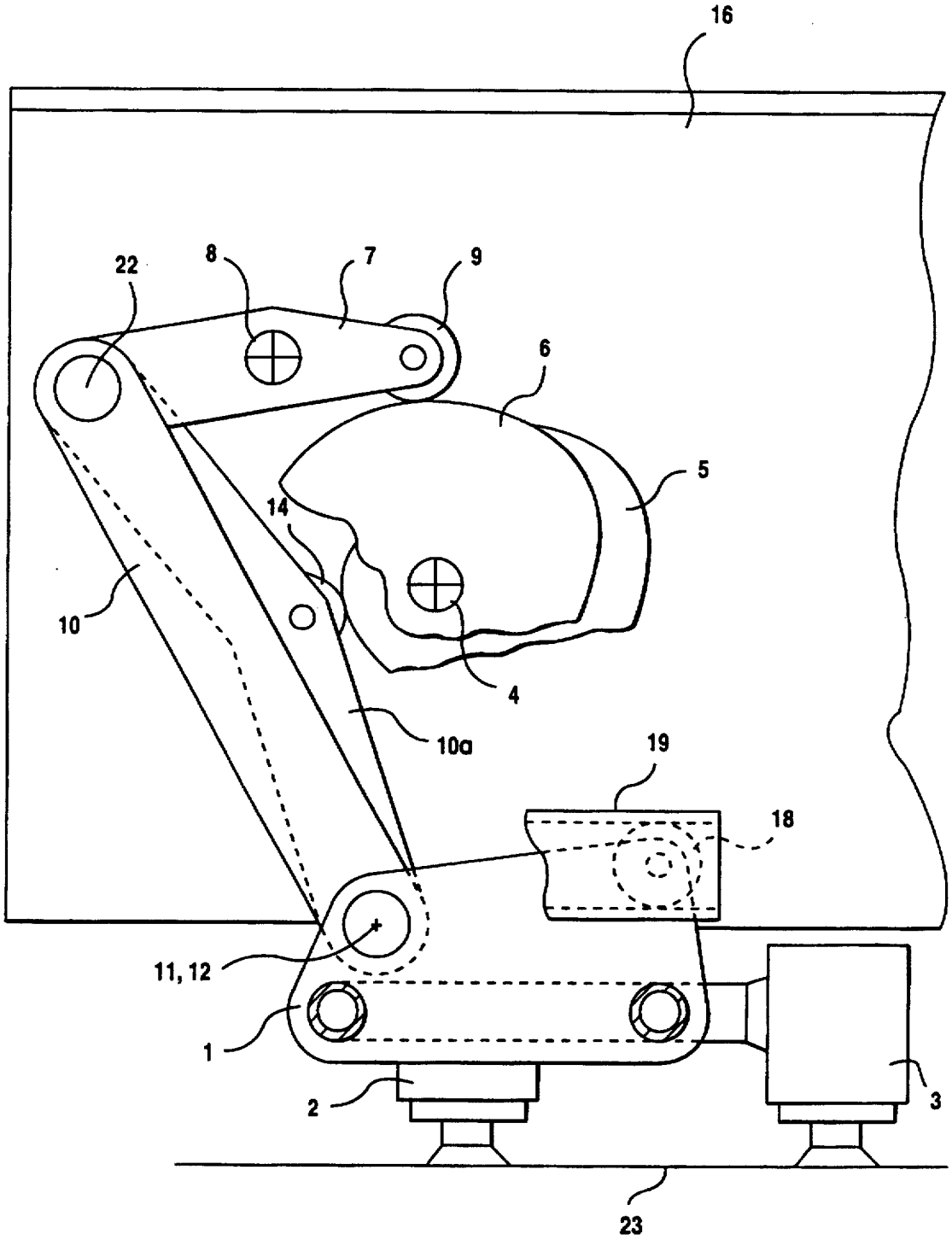
FIG. 2 is a side elevational view, partly in section and partly broken away, of another embodiment of the drive transmission of the pull or forwarding sucker having the features of the invention.

Referring now to the figures of the drawings and, first, particularly to FIG. 1 thereof, there is shown therein, approximately symmetrically to the center of the printing press, a plurality of pull or forwarding suckers 2 and 3 which are disposed on a sucker-carrying support 1 provided in a suction head of a sheet feeder, for example, a sheet feeder of a sheet-fed printing press, the sucker-carrying support extending approximately horizontally and being formed of a tubular frame. Translatory motion of the pull or forwarding suckers 2 and 3 fastened to the sucker-carrying support 1 is effected by two drive cams 5 and 6 mounted on a drive shaft 4 and having profiles differing from one another. A roller lever 7 is disposed on a shaft 8 firmly mounted in the press and has a cam follower 9 with which it engages the drive cam 6 so that it transmits the motion of the cam follower 9 effected by the cam 6 onto a coupler or connecting member formed of a frame 10 having two articulated connecting joints 11 and 12 which, with the sucker-carrying support 1, have a common axis. A cam follower 14 is mounted on a frame element 10*a* extending approximately vertically, the cam follower 14 engaging with the drive cam 5 mounted on the drive shaft 4 and causing the sucker-carrying support 1 to execute a preferably horizontal forwarding or pulling motion.

Vertical motion components of the sucker-carrying support 1 are reduced to a negligible extent by the second drive cam 6 via the roller lever 7. For a gear transmission for a pull or forwarding sucker without any device for correcting a misalignment-correction device, the sucker-carrying support 1 with a roller 18 mounted thereon is guided in a guide 19 running approximately parallel to the sheet 23 to be transported.

The approximately vertically extending frame element 10*a* of a misalignment-correction device is connected to the sucker-carrying support 1 by a bell-crank lever 13 which is swivelably mounted on the frame element 10*a*. One arm of the bell-crank lever 13 carries the connecting joint 12 with the sucker-carrying support 1, the axis of which, in a zero or null position, extends co-axially to the axis of the connecting joint 11. A roller 15 mounted on the other arm of the bell-crank lever 13 engages in a guide 17 adjustably disposed on the suction-head housing 16. The guide 17 for the roller 15 provided on the bell-crank lever 13 is swivelably mounted on the suction-head housing 16 so as to be movable about a swivel axis 20 and, at the other side thereof, it is connected to an adjusting device 21 formed of a spindle 21*a* rotatably mounted on the suction-head housing 16 and of a spindle nut 21*b* anchored to the guide 17 and pierced by the spindle 21*a* so that the guide 17 is movable about the swivel axis 20 by the adjusting device 21. Preferably, at the instant of time at which the sheet is taken over, the axis of the roller 15 extends in the guide 17 co-axially with the axis of the connection 20 between the guide 17 and the suction-head housing 16. This embodiment of the invention is guided on one side thereof. On the opposite side thereof, the roller 18 runs in a stationary guide 19 provided on the suction-head support 1, as described hereinbefore.

Figure 3:
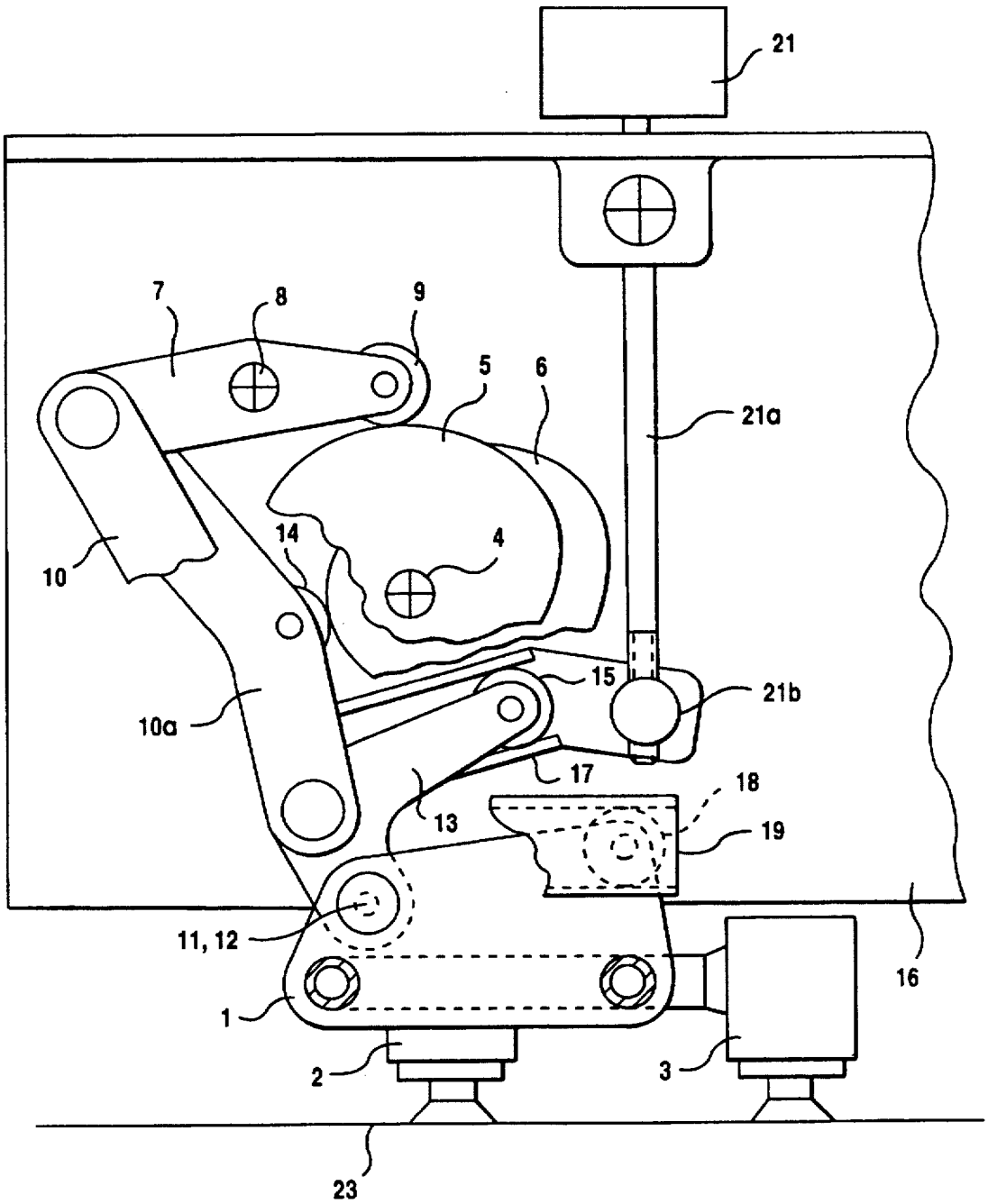
FIG. 3 is a side elevational view, partly in section and partly broken away, of the embodiment of the drive transmission for the pull or forwarding sucker shown in FIG. 1 provided with a device for correcting a misaligned sheet which is shown in an operating phase thereof at an instant of time at which the sheet is being taken over.
Figure 4:
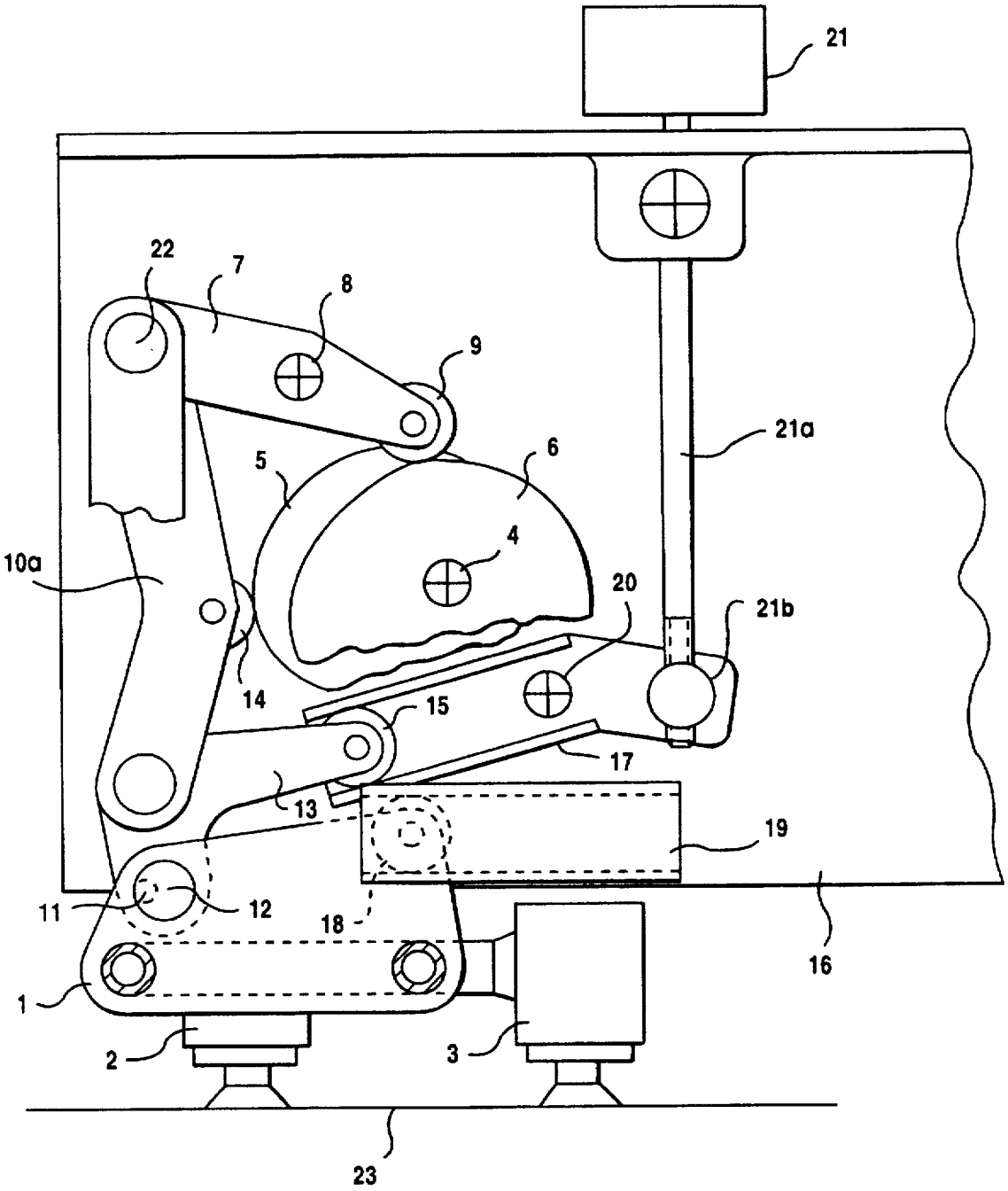
FIG. 4 is a view of the embodiment of the drive transmission for the pull or forwarding sucker according to FIG. 3 shown in an operating phase thereof shortly before the release of the sheet being transported.

FIG. 3 shows the location or setting of the drive transmission for the pull or forwarding sucker at the instant of time at which the sheets are taken from the sheet pile, and FIG. 4 shows the sheets at the instant of time at which they are transferred or being fed to the feeding table. In order to perform a correction of a misaligned sheet, the guide 17 is swiveled about the swivel axis 20 by the adjusting device 21, the swivel axis 20 and the axis of the roller 15 being identical at the instant of sheet take-over. As a result thereof, the axis of the roller 15 is displaced during the sheet transport, however, so that, in turn, the axis of articulation or the connecting joint 12 is displaced with respect to the articulation or the connecting joint 11. The latter displacement is recognizable from FIG. 4. The position of the axis of the articulation or connecting joint 12 must correspond to the position of the axis of the articulation or connecting joint 11 at the instant of time the sheets are taken over. By swiveling the guide 17, the axis of the articulation or connecting joint 12 is displaced substantially horizontally to the axis of the articulation or connecting joint 11. As a result thereof, the axis of the articulation or connecting joint 12 is only slightly displaced in the vertical direction, and this displacement does not have any noticeable effects upon the sheet position.

The articulations or connecting joints 11 and 12 are cardanic joints enabling the sucker-carrying support to rotate about the y-axis free of any clamping with respect to the coupler or connecting member 10 and the bell-crank lever 13. Preferably, the articulations or connecting joints 11 and 12 are ball and socket or universal joints. A great stability of the gear transmission for the pull or forwarding sucker is achieved by a stably or sturdily constructed roller lever 7 and a likewise sturdily constructed frame 10 in the form of a coupler or connecting member. The translatorily moved masses are limited essentially to the forwarding or pull suckers 2 and 3 and the sucker-carrying support 1 having relatively little mass. The contact between the drive cams 5 and 6 and the cam followers 9 and 14 is secured in a conventional manner by springs so that a functional operation is achieved producing little noise and causing little wear and tear.

Illustrated in the drawings is an embodiment of the invention having a suction head with additional lifting suckers.

We claim:

1. A drive transmission for correcting a misalignment of a sheet, comprising:

a sucker-carrying support moveable in a forward direction and in a transverse direction with respect to said forward direction for moving a sheet;

a first drive cam connected to said sucker-carrying support and moving said sucker-carrying support in said forward direction;

a second drive cam connected to said sucker-carrying support and moving said sucker-carrying support in said transverse direction, said second cam drive having a profile maintaining said movement in said transverse direction substantially horizontal;

a frame element connecting said first and second drive cams to said sucker-carrying support;

a bell-crank lever having an arm with a roller mounted thereon, said bell-crank lever swivelably mounted to said frame element;

a guide engaging said roller of said bell-crank lever; and an adjuster moveably mounting said guide to adjust said transverse movement of said sucker-carrying support.

2. The drive transmission according to claim 1, wherein:

said frame element is a first frame element; and the drive transmission includes:

a second frame element defining a frame with said first frame element;

said frame and said sucker-carrying support having two connecting joints with a common axis.

3. The drive transmission according to claim 2, wherein one of said connecting joints is disposed on said bell-crank lever, and said bell-crank lever is mounted on said frame so as to be swivelable about an axis extending parallel to said common axis of said two connecting joints.

4. The drive transmission according to claim 1, wherein:

said frame element is a first frame element; and the drive transmission includes:

a second frame element defining a frame with said second frame element; and two connecting joints movable in a cardanic manner between said frame and the sucker-carrying support.

5. The drive transmission according to claim 4, including a housing, said guide adjustably disposed on said housing.

* * * * *